US007074995B2

(12) United States Patent
Barakat

(10) Patent No.: US 7,074,995 B2
(45) Date of Patent: Jul. 11, 2006

(54) UNIQUE SOUNDING DRUM

(76) Inventor: Yaser K. Barakat, 4809 Rutgers St., Apt. #14, Roanoke, VA (US) 24012

( * ) Notice: Subject to any disclaimer, the term of this patent is extended or adjusted under 35 U.S.C. 154(b) by 91 days.

(21) Appl. No.: 10/880,594

(22) Filed: Jul. 1, 2004

(65) Prior Publication Data

US 2006/0000340 A1 Jan. 5, 2006

(51) Int. Cl.
*G10D 13/02* (2006.01)

(52) U.S. Cl. ..... 84/411 R; 84/419

(58) Field of Classification Search ..... 84/411 R, 84/413, 419, 422.4, 422.1; D17/22
See application file for complete search history.

(56) References Cited

U.S. PATENT DOCUMENTS

| | | | | |
|---|---|---|---|---|
| 355,970 | A | 1/1887 | Boulanger | |
| 421,213 | A | 2/1890 | Walsh | |
| 1,469,197 | A | 9/1923 | Strupe | |
| 1,980,876 | A * | 11/1934 | Peters | 84/411 R |
| 2,204,987 | A | 6/1940 | Gussak | |
| D163,538 | S | 6/1951 | Orta | |
| 3,185,013 | A | 5/1965 | Gussak | |
| D241,974 | S | 10/1976 | Huster et al. | |
| D242,875 | S | 12/1976 | Clements et al. | |
| D244,798 | S | 6/1977 | Fleck | |
| 4,077,297 | A * | 3/1978 | Woodson | 84/411 R |
| 4,112,807 | A | 9/1978 | Quibell | |
| 4,184,407 | A | 1/1980 | Townshend | |
| 4,256,006 | A | 3/1981 | Widener | |
| 4,373,419 | A | 2/1983 | Tuttrup | |
| 4,798,121 | A | 1/1989 | Donohoe | |
| 4,831,912 | A * | 5/1989 | Allen | 84/419 |
| 5,301,591 | A | 4/1994 | Greenberg | |
| 5,377,576 | A | 1/1995 | Good et al. | |
| 5,610,350 | A | 3/1997 | Miller | |
| 5,693,900 | A * | 12/1997 | Calato et al. | 84/422.4 |

(Continued)

FOREIGN PATENT DOCUMENTS

| | | |
|---|---|---|
| GB | 678827 | 9/1952 |

(Continued)

OTHER PUBLICATIONS

Musician's Friend—Casablanca Aluminum Doumbek With Case (440750); 2004; http://www.musiciansfriend.com/srs7/search/detail/base_pid/440750/sourceid=qDToQH7N1KuVAToTiUuz/befree_site_id=0020583305.

(Continued)

*Primary Examiner*—Marlon T. Fletcher
*Assistant Examiner*—Jianchun Qin
(74) *Attorney, Agent, or Firm*—Richard C. Litman

(57) ABSTRACT

The unique sounding drum is a drum assembly having a metal body, a pair of upper rings and a membrane stretched across the top of the metal body and extended between the pair of upper rings. The metal body has a general hourglass configuration with an upper portion decreasing in diameter from a top opening to a midsection, and a lower portion increasing in diameter from the midsection to a bottom opening. A semi-circumferential arcuate relief extends partially, across the widths of the upper rings. The arcuate relief may have a plurality of grooves, dimensioned to have different widths and circumferential lengths. Additionally, the metal body has an interior chamber with a plurality of scratchings on it, which provide the drum assembly with a clearer voice and sound. The drum assembly may include a mallet, a cover made from a soft material, and an elastic cord.

19 Claims, 7 Drawing Sheets

U.S. PATENT DOCUMENTS

| | | | | |
|---|---|---|---|---|
| 6,040,513 | A | 3/2000 | Belli | |
| 6,150,594 | A | 11/2000 | Fiondella et al. | |
| 6,162,977 | A | 12/2000 | Cohen | |
| 6,515,208 | B1 | 2/2003 | Cleland | |
| 6,552,253 | B1 * | 4/2003 | Chen | 84/413 |
| 2001/0049993 | A1 * | 12/2001 | Hagiwara | 84/411 R |
| 2003/0029302 | A1 | 2/2003 | Reed | |
| 2003/0061929 | A1 | 4/2003 | Dye et al. | |
| 2003/0136243 | A1 * | 7/2003 | Bourgoin | 84/411 R |

FOREIGN PATENT DOCUMENTS

| | | |
|---|---|---|
| JP | 2002-162962 | 6/2002 |

OTHER PUBLICATIONS

Pecussion—Hand Drums, Talking Drums, Congas, Bongos; 2002; http://www.sonicmagician.com/drums_percussion/percussion.html.

* cited by examiner

UNIQUE SOUNDING DRUM

BACKGROUND OF THE INVENTION

1. Field of the Invention

The present invention relates to drums, and particularly to a unique sounding drum.

2. Description of the Related Art

Drums have been used by civilizations for thousands of years to provide music for their people, warn against danger, and make pronouncements. Drums are generally made from a hollow body and a membrane stretched across the top of the body. The membrane is struck either with an individual's hands or with a stick. The membrane then reverberates, creating a sound.

Many types of drums have emerged over the years that produce different sounds depending on the shape of the body, the type of membrane used and the material used to form the body. The first drums were generally hollow tree trunks or bones that had an animal skin stretched across the top. As mankind progressed, these primitive drums evolved. Kettle drums, steel drums, and bongo drums are just a few examples of drum types that have grown out of various cultures. In more recent years, drums having different sounds have been combined into drum sets, usually including tenor, bass and snare drums, all of which produce distinct sounds.

Although different drums have been developed with unique sounds, it would be advantageous to have an evener wider array of drums with distinct sounds. Thus drummers would be able to use an even broader range of sound.

U.S. Pat. No. 2,204,987, issued Jun. 18, 1940 to W. Gussak describes a drum having a general hourglass configuration. The drum body has two cup-shaped ends made of gourd and is made with gourd, cardboard or similar material.

U.S. Pat. No. 3,185,013, issued May 25, 1965 to W. Gussak, shows a drum with a cylindrical body. The body has two ends that are open-ended and cup-shaped. Additionally, the drum has a gripping device that surrounds the drum and allows the user to better grasp the drum.

U.S. Pat. No. 6,040,513, issued Mar. 21, 2000 to R. Belli, describes a drum fashioned in a shape similar to an hourglass configuration. A drumhead is included on either end of the drum. A series of cord strands are threaded from one end of the drum to the other, defining a series of slotted openings.

U.S. Pat. No. Des. 244,798, issued Jun. 21, 1977 to F. Fleck, shows a drum having an hourglass configuration. The drum is supported on a stand.

U.S. Pat. Pub. No. U.S. 2001/0049993 A1, published Dec. 13, 2001 and invented by T. Hagiwara describes a drum body with first, second and third body elements. The drum body elements may be manufactured with metals such as aluminum or steel or with fiber-reinforced plastics.

Other patents showing drums include U.S. Pat. No. Des. 163,538, issued Jun. 5, 1951 to O. Orta (drum); U.S. Pat. No. Des. 241,974, issued Oct. 19, 1976 to W. Huster et al. (drum musical instrument); U.S. Pat. No. Des. 242,875, issued Dec. 28, 1976 to A. Clements et al. (musical drum); U.S. Pat. Pub. No. U.S. 2003/0029302 A1, published Feb. 13, 2003 and invented by K. Reed (musical drum); U.S. 2003/0061929 A1, published Apr. 3, 2003 and invented by M. Dye et al. (percussion instrument);

Further patents showing drums include U.S. Pat. No. 355,970, issued Jan. 11, 1887 to E. Boulanger (tympanum); U.S. Pat. No. 421,213, issued Feb. 11, 1890 to F. Walsh (sheet metal vessel); U.S. Pat. No. 1,469,197, issued Sep. 25, 1923 to C. Strupe (tympano); U.S. Pat. No. 4,077,297, issued Mar. 7, 1978 to C. Woodson (variable pitch drum); U.S. Pat. No. 4,112,807, issued Sep. 12, 1978 to P. Quibell (conga drum set); U.S. Pat. No. 4,184,407, issued Jan. 22, 1980 to P. Townshend (acoustic drums); U.S. Pat. No. 4,256,006, issued Mar. 17, 1981 to G. Widener (multi-tone percussion instrument); U.S. Pat. No. 4,373,419, issued Feb. 15, 1983 to G. Tuttrup (drum apparatus); U.S. Pat. No. 4,798,121, issued Jan. 17, 1989 to D. Donohoe (impact resistant drumhead); and U.S. Pat. No. 4,831,912, issued May 23, 1989 to B. Allen et al. (kettledrum).

Additional patents showing drums include U.S. Pat. No. 5,301,591, issued Apr. 12, 1994 to M. Greenberg (tapered snare drum); U.S. Pat. No. 5,377,576, issued Jan. 3, 1995 to J. Good et al. (drum construction having wood and metal wall sections); U.S. Pat. No. 5,610,350, issued Mar. 11, 1997 to B. Miller (variable pitch drum); U.S. Pat. No. 6,150,594, issued Nov. 21, 2000 to M. Fiondella et al. (drumming apparatus); U.S. Pat. No. 6,162,977, issued Dec. 19, 2000 to W. Cohen (bongo drums); U.S. Pat. No. 6,515,208 B2, issued Feb. 4, 2003 to T. Cleland (tensioning system for a musical drum); U.K. Pat. No. 678,827, published Sep. 10, 1952 (improvements in or relating to musical drums); Jap. Pat. No. 2002-162962, published Jun. 7, 2002 (Japanese drum (hand drum)); and http://www.musiciansfriend.com/srs7/search/detail/base pid/440750/sourceid=qDToQH7N1KuVAToTiUuz/befree site id=0020583305; and http://www.sonicmagician.com/drums percussion/percussion.html.

While a variety of drums are available in the prior art, what is needed is a drum producing a unique sound or tone, distinct from typical drum sounds.

None of the above inventions and patents, taken either singly or in combination, is seen to describe the instant invention as claimed. Thus a unique sounding drum solving the aforementioned problems is desired.

SUMMARY OF THE INVENTION

The unique sounding drum provides a unique sound or tone when struck by a user. The unique sounding drum is a drum assembly having a metal body, a pair of upper rings and a membrane stretched across the top of the metal body and extended between the pair of upper rings. The drum assembly may include a mallet, a cover made from a soft material, and an elastic cord.

The metal body has a general hourglass configuration with an upper portion, a lower portion and a midsection between the upper and lower portions. The upper portion decreases in cross-sectional diameter from a top opening of the metal body to the midsection, and the lower portion increases in cross-sectional diameter from the midsection to a bottom opening of the metal body. The diameter of the bottom opening is smaller than the diameter of the top opening.

The drum assembly additionally includes a pair of upper metal rings and a membrane made of plastic matte or a similar material. The upper rings are supported about the top opening of the metal body, and the membrane is stretched across the top opening and extended between the pair of upper rings. The upper rings hold the membrane taut across the top opening of the metal body. Each of the upper rings has an inner periphery and an outer periphery defining a width there between. At least one semi-circumferential arcuate relief extends partially across the widths of the upper rings between the inner and outer peripheries of each ring. The arcuate relief additionally extends circumferentially about the circumference of each upper ring. The membrane extends across the arcuate relief. The sound of the membrane over the arcuate relief provides a generally higher pitched sound when struck than the sound of the membrane over the top opening.

The arcuate relief may have a plurality of grooves, dimensioned to have different widths and circumferential lengths. The membrane provides a different sound when struck depending on the groove across which it is stretched. The sound is generally higher pitched for the grooves with shorter circumferential lengths and lesser widths.

The metal body has an interior chamber with a plurality of scratchings disposed on the surface of the chamber. The drum assembly produces a clearer voice and sound when the scratchings are made on the interior chamber of the aluminum body.

The drum assembly may include a cover designed to envelop the membrane. The cover, made from a soft material such as cotton, provides a deeper sound from the drum assembly when the membrane with the cover is struck. An elastic cord may also be included. The elastic cord is designed to stretch across the membrane. When the membrane is struck, a snare sound is produced.

It is an aspect of the invention to provide a drum having a unique sound and tone. It is an additional aspect of the invention to provide various pitched sounds, depending on which section of the drum assembly is struck.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
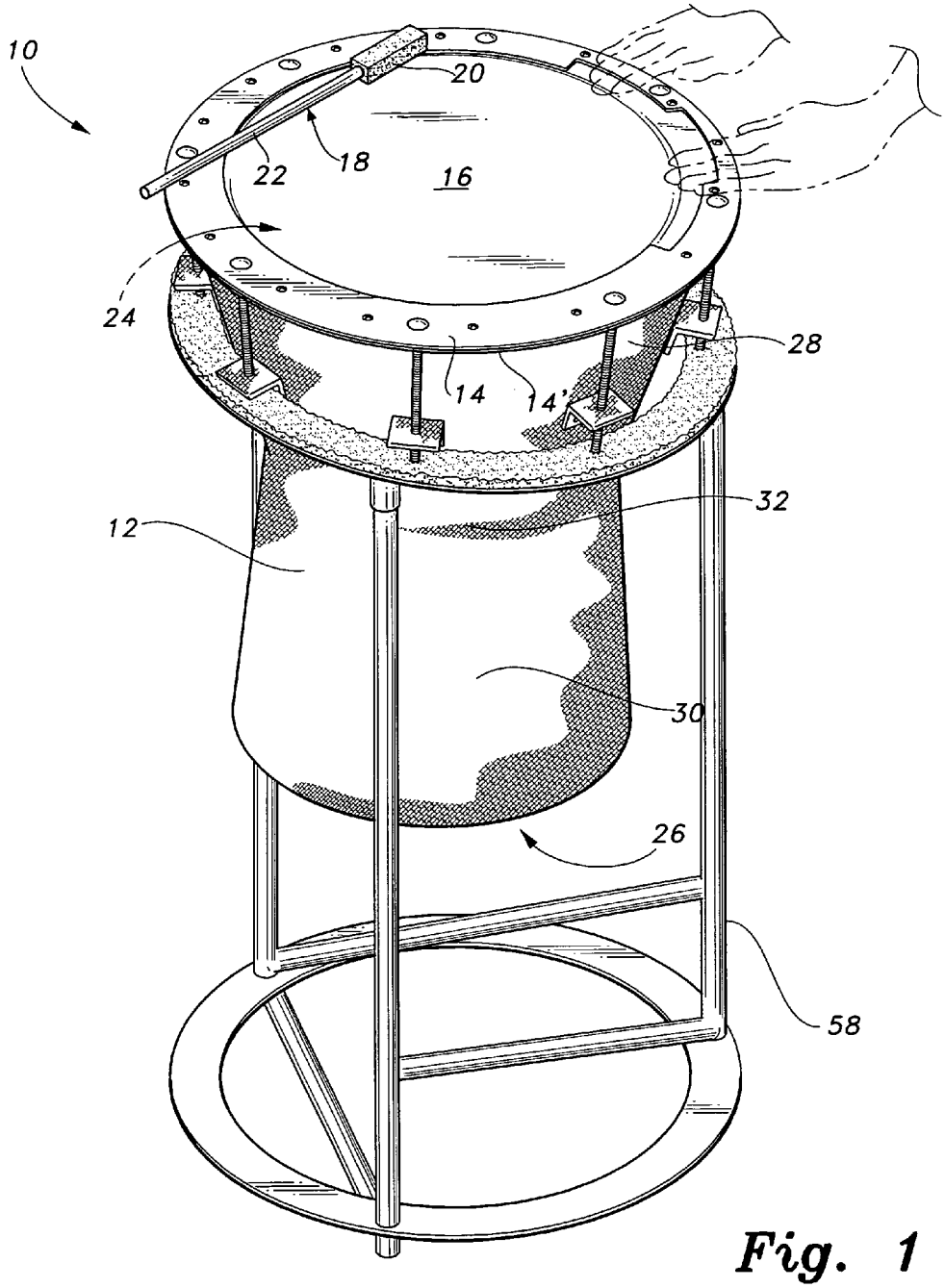
FIG. 1 is a perspective view of a drum assembly according to the present invention.

The present invention is a drum assembly, designated generally as 10 in the drawings, having a unique sound and tone. The drum assembly 10 has a metal body 12, a pair of upper metal rings 14 and 14', and a membrane 16 stretched across the top of the metal body 12 and extended between the pair of upper rings 14 and 14'. Additionally, the drum assembly 10 may include a mallet 18, a cover 80 made from a soft material, and an elastic cord 82.

Figure 2:
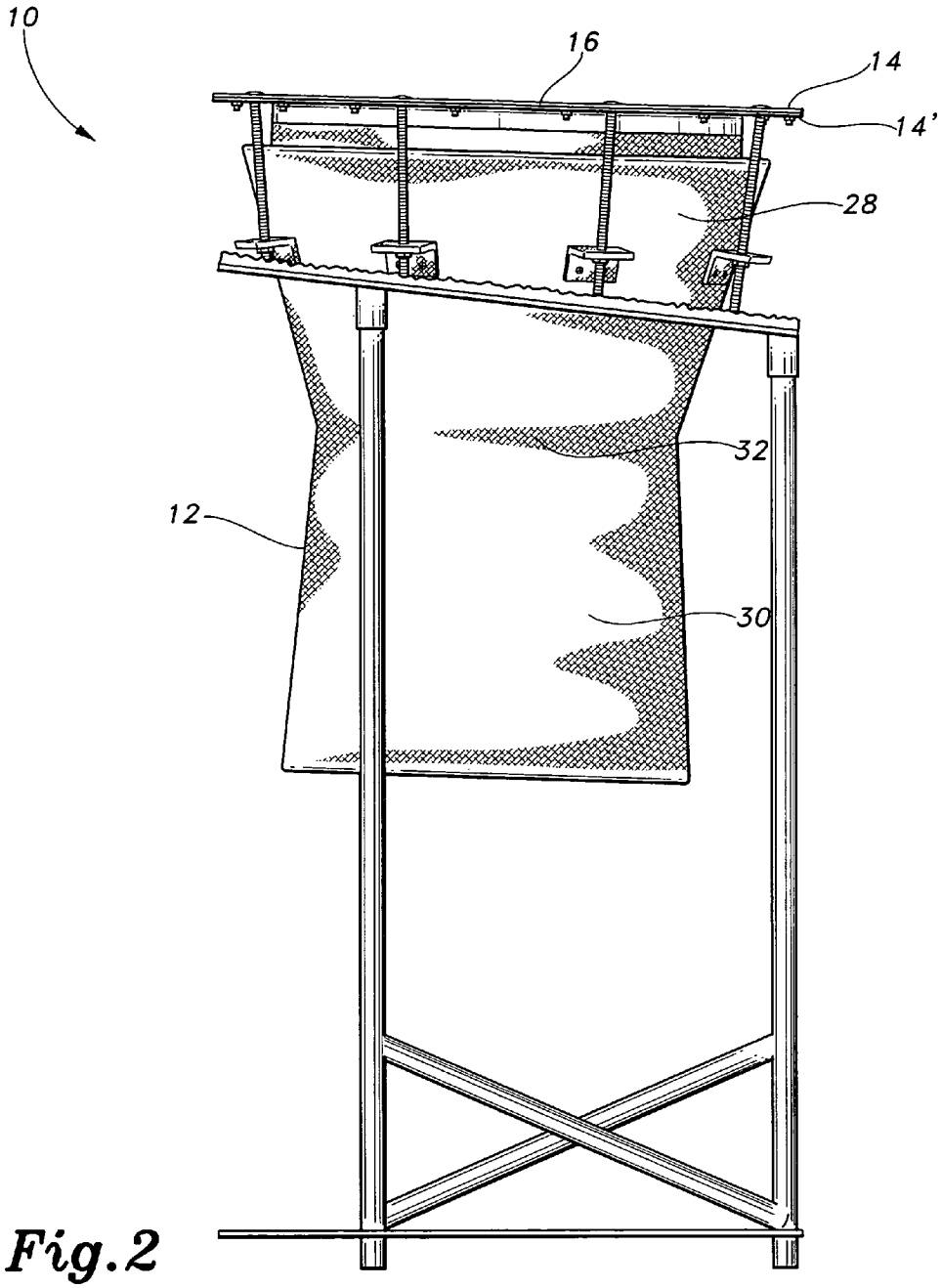
FIG. 2 is an elevational side view of the drum assembly according to the present invention.

Referring first to FIGS. 1 and 2, the metal body 12 has a general hourglass configuration. The metal body 12 may be made with aluminum or various grades of metal alloys. The metal body 12 is hollow with a top opening 24 (not seen) and a bottom opening 26. The metal body 12 has an upper portion 28, a lower portion 30 and a midsection 32 between the upper and lower portions 28 and 30. The upper portion 28 decreases in cross-sectional diameter from the top opening 24 to the midsection 32. Then the lower portion 30 increases in cross-sectional diameter from the midsection 32 to the bottom opening 26. The diameter of the bottom opening 26 is less than the diameter of the top opening 24. The lower portion 30 of the metal body 12 is two inches longer than the upper portion 28 of the metal body 12.

A mallet 18 is shown having a foam head 20 and a handle 22 to which the foam head 20 is attached. The foam head 20 is dimensioned for striking the membrane 16.

Figure 3:
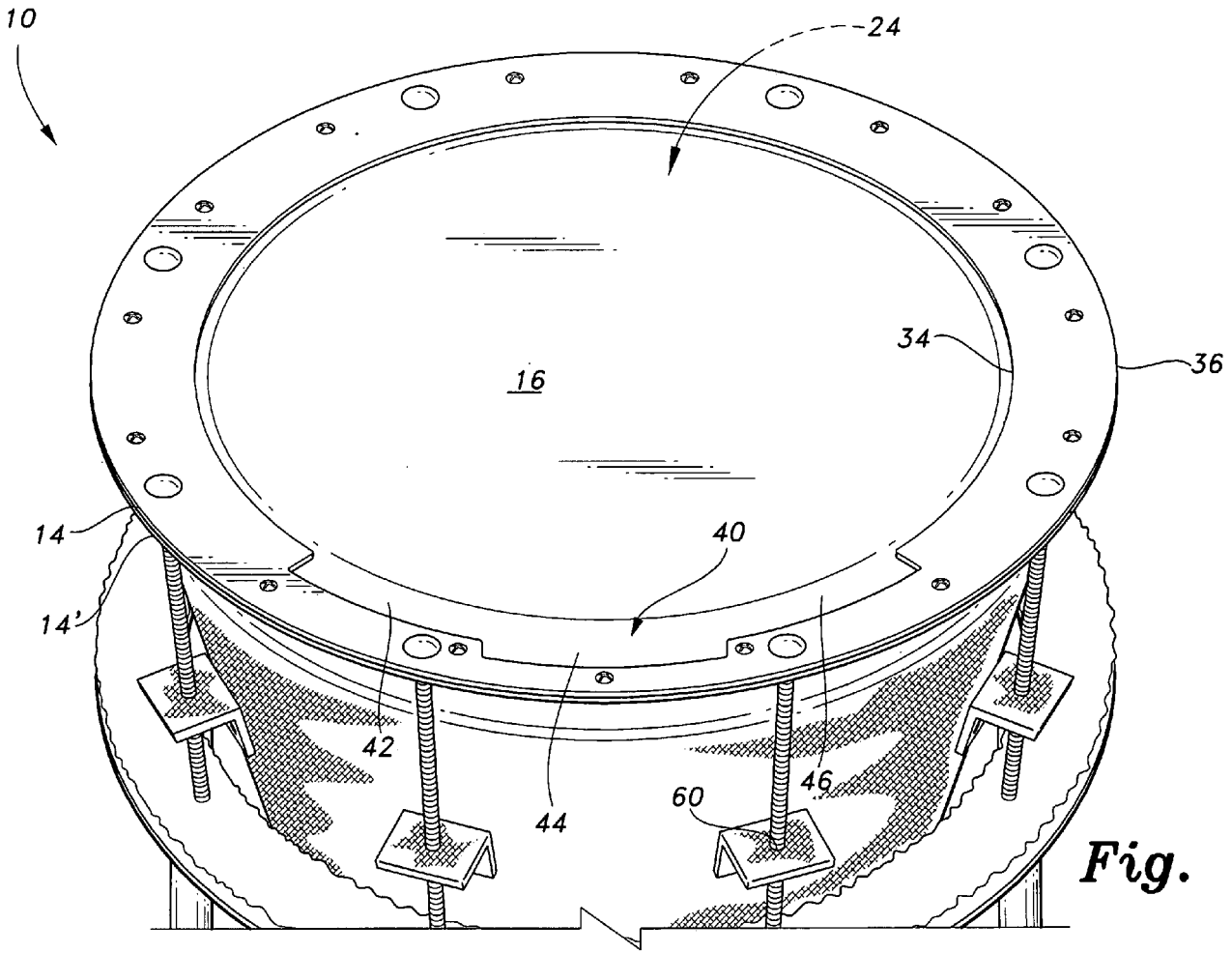
FIG. 3 is a perspective top view of the drum assembly according to the present invention.

Turning now to FIG. 3, the drum assembly 10 additionally includes a pair of upper metal rings 14 and 14' and a membrane 16. The membrane 16 is designed to be struck by a user, either with the user's hand, a stick (not shown) or the mallet 18. The membrane 16 may be made of a plastic matte or any other appropriate material. Each of the upper rings 14 and 14' has an inner periphery 34 and an outer periphery 36 defining a width there between. The upper rings 14 and 14' are supported about the top opening 24 of the metal body 12 by being attached to a mounting ring 52. The mounting ring 52 is supported by a drum stand 58. The membrane 16 is stretched across the top opening 24 of the metal body 12 and extended between the pair of rings 14 and 14', which hold the membrane 16 taut across the top opening 24. The upper rings 14 and 14' each have widths of two inches.

At least one semi-circumferential arcuate relief 40 extends partially across the widths of the upper rings 14 and 14' between the inner periphery 34 and the outer periphery 36 of each ring 14 and 14'. The membrane 16 extends across the arcuate relief 40. The arcuate relief 40 extends circumferentially about the circumference of each upper ring 14 and 14'. The arcuate relief 40 may preferably extend circumferentially from approximately 45 degrees to approximately 70 degrees about the circumference of each ring 14 and 14'. The arcuate relief 40 may, however, extend to a greater degree or extend around the entire circumference of each upper ring 14 and 14'.

The membrane 16 over the arcuate relief 40 may be struck, providing a generally higher pitched sound than the sound the membrane 16 over the top opening makes when struck. In one embodiment, the arcuate relief 40 has a plurality of grooves 42, 44 and 46. The first and third grooves 42 and 46 extend three-quarters of an inch between the inner periphery 34 and the outer periphery 36 of each upper ring 14 and 14'. The second groove 44 extends one and one-quarter of an inch between the inner periphery 34 and the outer periphery 36 of each upper ring 14 and 14'. A user may strike either the membrane 16 stretched across the top opening 24 or may strike the arcuate relief 40, as seen in FIG. 1. The membrane 16 provides a different sound when struck on the arcuate relief 40 depending on the groove 42, 44 or 46 across which the membrane 16 is stretched. The sound is generally higher pitched for the grooves having a shorter circumferential length and a lesser width, for example grooves 42 and 46.

The drum assembly 10 is tilted very slightly in the direction of the arcuate relief 40, which allows the user to more easily access the relief 40 and the drum membrane 16.

Figure 4:
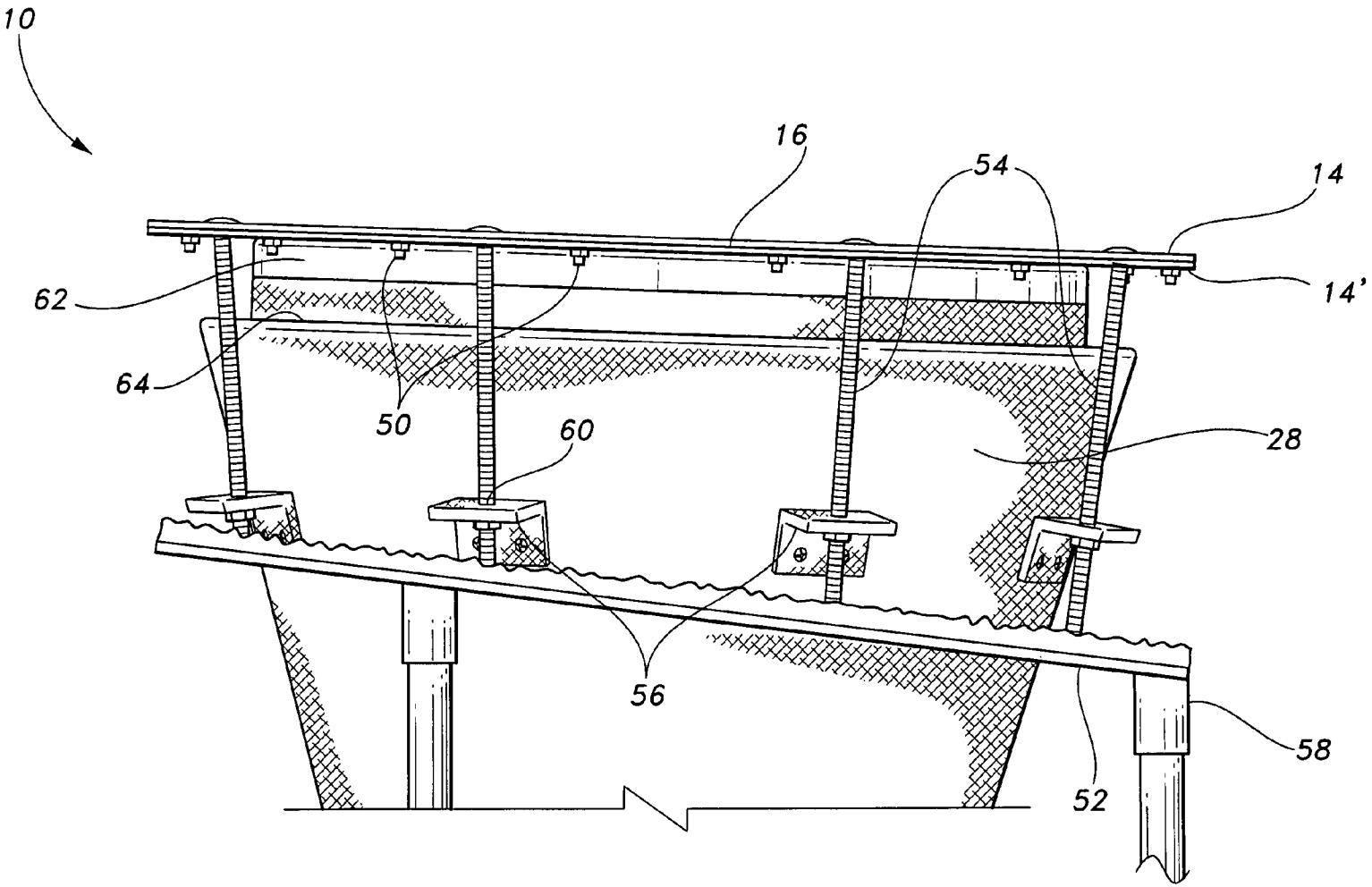
FIG. 4 is an elevational side view of the upper portion of the drum assembly according to the present invention.

FIG. 4 shows the upper portion 28 of the metal body 12. One of the upper rings 14 sits atop the other upper ring 14'. A plurality of fasteners 50 secures the upper rings 14 and 14' and the membrane 16 together. The upper portion 28 additionally includes the mounting ring 52, a plurality of bolts 54, and a plurality of mounting brackets 56 affixed perpendicular to the drum body 12. The mounting ring 52 is supported about the upper portion 28 of the body 12 by the drum stand 58. The bolts 54 secure the upper rings 14 and 14' to the mounting ring 52. The bolts 54 pass through apertures 60 in the mounting brackets 56 and attach onto the mounting ring 52.

The mounting ring 52 slants lower on the side of the drum assembly 10 that is beneath the arcuate relief 40, allowing the drummer easier access to that side of the membrane 16.

The metal body 12 of the drum assembly 10 has a rim 62 and a lip 64. The rim 62 extends circumferentially about the top opening 24. The rim 62 may range in height, but preferentially has a height of one and one half inch. The lip 64 is disposed slightly lower and extends away from the rim 62. The lip 64 may range in width away from the rim 62, but preferentially has a width of one inch.

Figure 5:
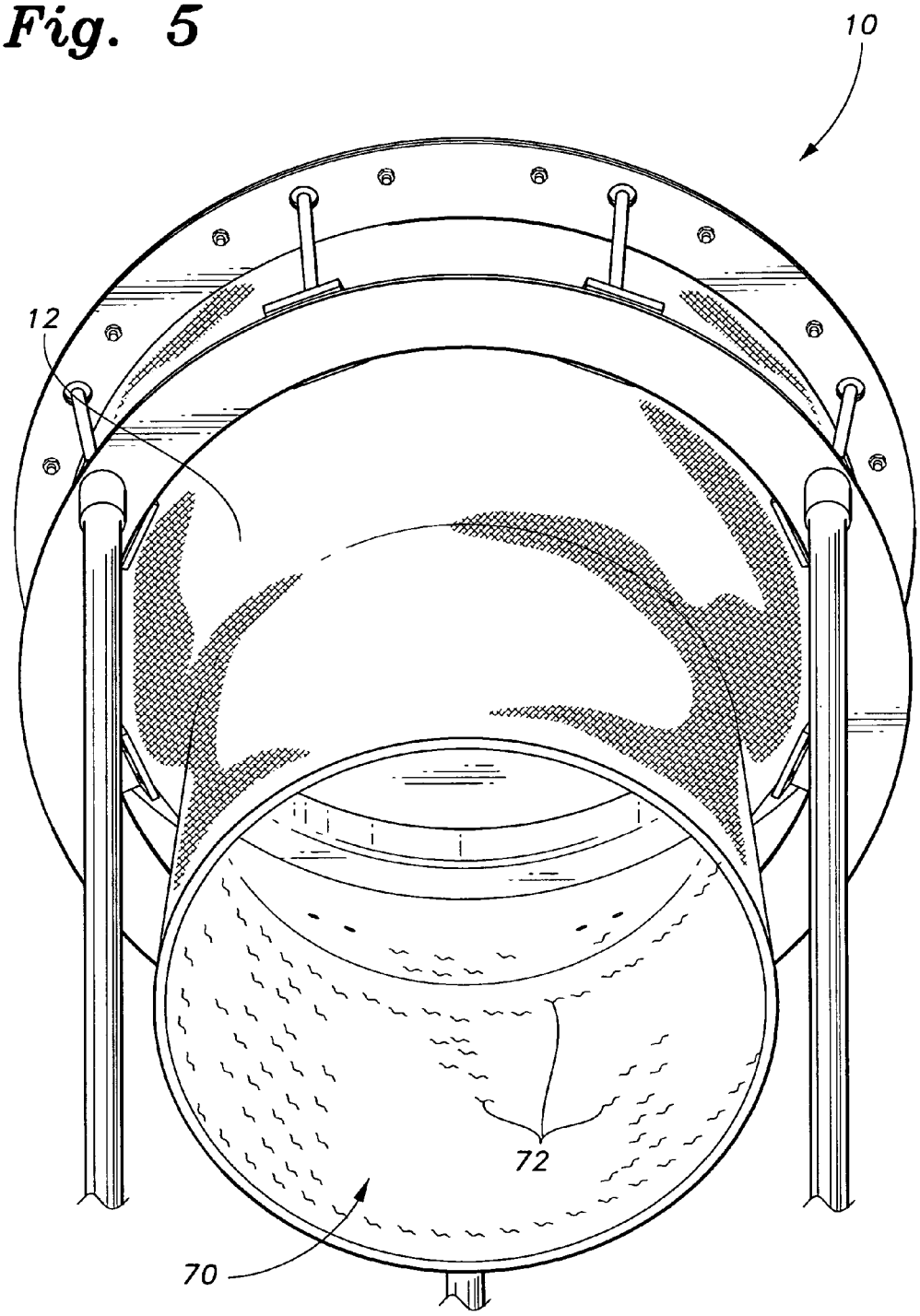
FIG. 5 is a perspective view of the interior chamber of the drum assembly according to the present invention.

FIG. 5 shows the interior chamber 70 of the metal body 12. The interior chamber 70 has a plurality of scratchings 72 on the surface of the chamber 70. The scratchings 72 give the drum assembly 10 a clearer voice and sound when the membrane 16 is struck.

Figure 6:
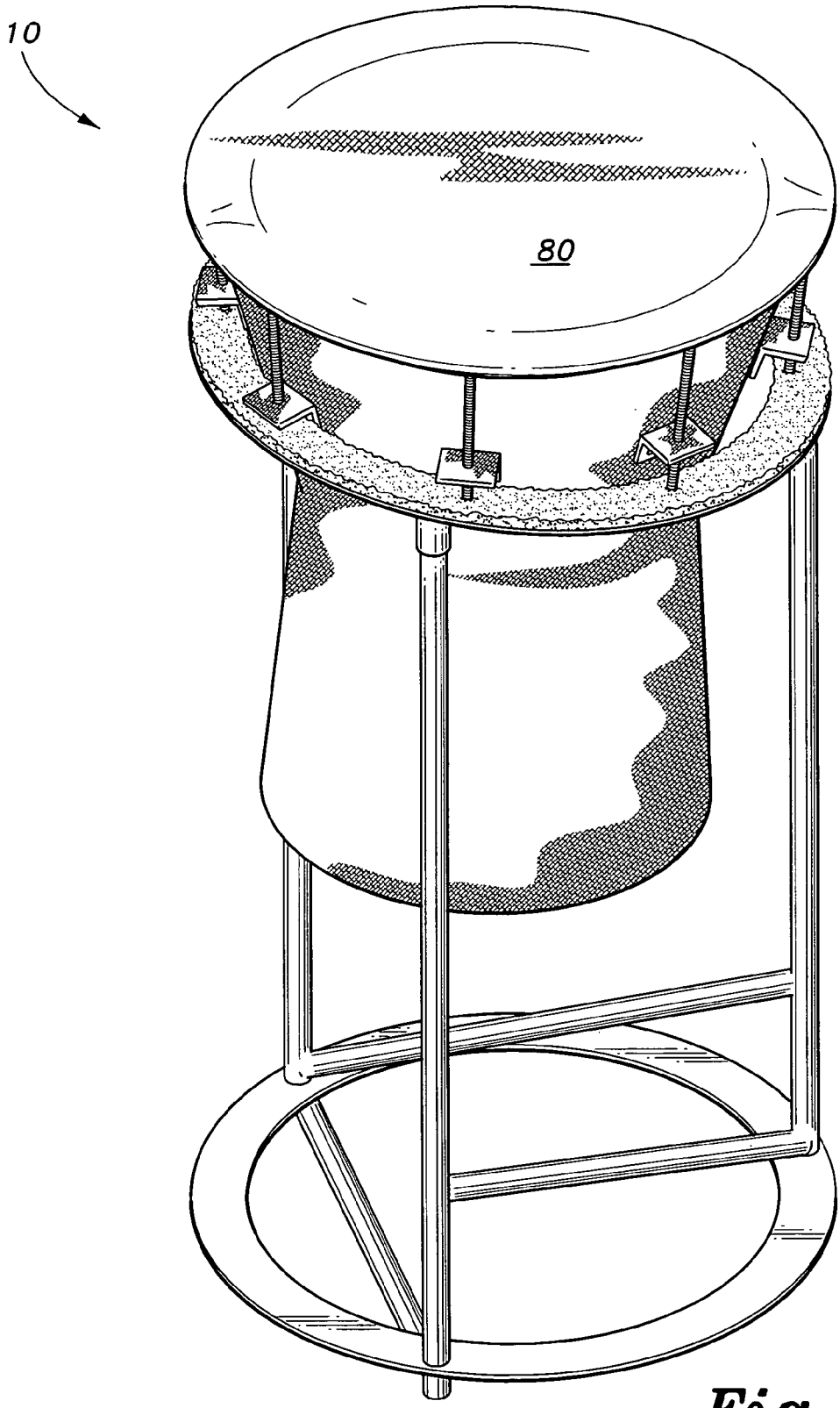
FIG. 6 is a perspective view of the drum assembly according to the present invention with a cover.

FIG. 6 shows the drum assembly 10 with a cover 80. The cover 80 is adapted to envelop the membrane 16 and the pair of upper rings 14 and 14'. The cover 80 is made from a soft material, such as cotton, and provides the drum assembly 10 with a deeper sound when the membrane 16 with the cover 80 over it is struck.

Figure 7:
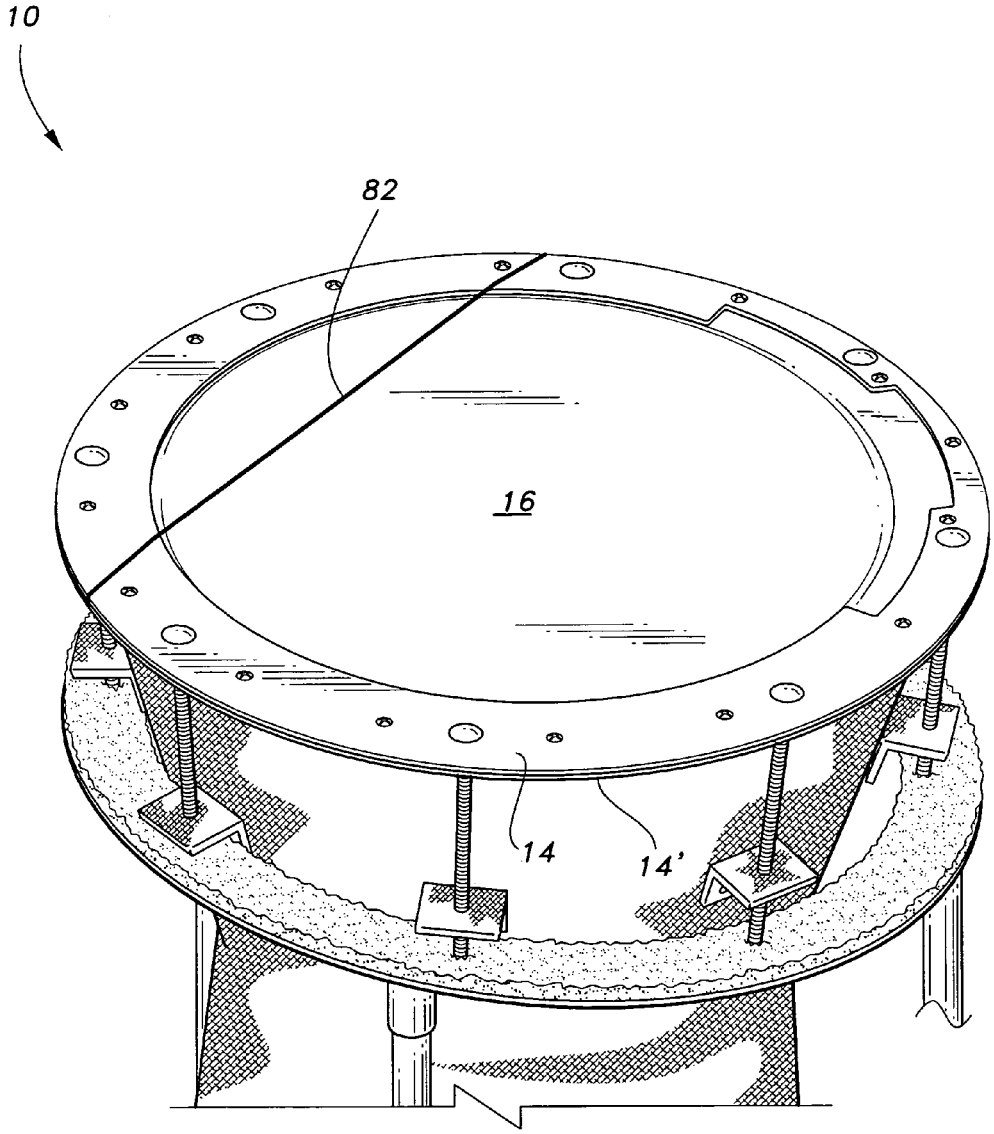
FIG. 7 is a perspective top view of the drum assembly according to the present invention with an elastic cord.

FIG. 7 shows the elastic cord 82 stretched across the upper rings 14 and 14' and the membrane 16. The elastic cord 82 being placed across the membrane 16 provides a snare sound when the membrane 16 is struck.

It is to be understood that the present invention is not limited to the embodiments described above, but encompasses any and all embodiments within the scope of the following claims.

I claim:

1. A drum assembly comprising:

(a) a metal body having a general hourglass configuration with atop opening and a bottom opening, the metal body further comprising an upper portion, a lower portion and a midsection between the upper and lower portions, the upper portion decreasing in diameter from the top opening to the midsection and the lower portion increasing in diameter from the midsection to the bottom opening, wherein the metal body has an interior chamber, the interior chamber of the metal body having a plurality of scratchings;

(b) a pair of upper metal rings each having an inner periphery and an outer periphery defining a width therebetween, said upper rings being supported about the top opening of the metal body; and (c) a membrane across the top opening of the metal body and extending between the pair of rings.

2. The drum assembly according to claim 1, wherein the metal body is made from aluminum.

3. The drum assembly according to claim 1, wherein the bottom opening has a smaller diameter than the top opening.

4. The drum assembly according to claim 1, wherein the lower portion of the metal body is two inches longer than the upper portion of the metal body.

5. The drum assembly according to claim 1, wherein the metal body has a rim and a lip, the rim circumferentially extended about the top opening and the lip disposed slightly lower and extended away from the rim.

6. The drum assembly according to claim 5, wherein the rim has a height of one and one half inch.

7. The drum assembly according to claim 5, wherein the lip has a width of one inch.

8. The drum assembly according to claim 1, wherein the upper rings have widths of two inches.

9. The drum assembly according to claim 1, further comprising:

(a) a mounting ring;

(b) a plurality of mounting brackets attached to the upper portion of the metal body, each of the mounting brackets having an aperture; and (c) a plurality of bolts, each of the bolts extending through each of the apertures and securing the upper rings to the mounting ring; and (d) a drum stand supporting the mounting ring.

10. The drum assembly according to claim 1, further comprising a foam mallet having a head dimensioned for striking the membrane.

11. The drum assembly according to claim 1, further comprising an elastic cord, the elastic cord adapted to stretch across the membrane.

12. The drum assembly according to claim 1, wherein the membrane is plastic.

13. The drum assembly according to claim 1, further comprising a cotton cover adapted to envelop the membrane and the upper rings.

14. A drum assembly comprising:

a metal body having a general hourglass configuration with a top opening and a bottom opening, the metal body further comprising an upper portion, a lower portion and a midsection between the upper and lower portions, the upper portion decreasing in diameter from the top opening to the midsection and the lower portion increasing in diameter from the midsection to the bottom opening;

a pair of upper metal rings each having an inner periphery and an outer periphery defining a width therebetween, said upper rings being supported about the top opening of the metal body;

a membrane across the top opening of the metal body and extending between the pair of rings; and at least one semi-circumferential arcuate relief extending partially across the widths of the upper rings between the inner periphery and outer periphery of each upper ring, the membrane extending across the arcuate relief.

15. The drum assembly according to claim 14, wherein the arcuate relief extends circumferentially about the circumference of the upper rings.

16. The drum assembly according to claim 15, wherein the arcuate relief extends circumferentially from approximately 45 degrees to approximately 70 degrees about the circumference of the upper rings.

17. The drum assembly according to claim 14, wherein the arcuate relief has a plurality of grooves.

18. The drum assembly according to claim 17, wherein one of the grooves extends three-quarters of an inch between the inner periphery and the outer periphery of each upper ring.

19. The drum assembly according to claim 17, wherein one of the grooves extends one and one-quarter of an inch between the inner periphery and the outer periphery of each upper ring.

* * * * *